US005452899A

United States Patent [19]

Skratulia et al.

[11] Patent Number: 5,452,899

[45] Date of Patent: Sep. 26, 1995

[54] METHOD OF PLAYING A WAGERING GAME

[76] Inventors: John Skratulia, 11402 Howard St., Whittier, Calif. 90601; Fred Wolf, 10418 Lubao Ave., Chatsworth, Calif. 91311

[21] Appl. No.: 368,556

[22] Filed: Jan. 4, 1995

[51] Int. Cl.[6] ..... A63F 1/00

[52] U.S. Cl. ..... 273/292; 273/309

[58] Field of Search ..... 273/292, 309, 273/274, 85 CP

[56] References Cited

U.S. PATENT DOCUMENTS 3,998,462 12/1976 Goott ..... 273/274
5,013,049 5/1991 Tomaszewski ..... 273/292
5,314,194 5/1994 Wolf ..... 273/292
5,417,430 5/1995 Breeding ..... 273/292

*Primary Examiner*—Benjamin H. Layno
*Attorney, Agent, or Firm*—Timothy T. Tyson; Ted Masters; Freilich, Hornbaker & Rosen

[57] ABSTRACT

A method of playing a wagering game 20 wherein a plurality of players select sets of winning numbers (step 26). Play includes the players placing wagers (step 24), the dealer dealing two cards face up (step 28), the dealer comparing the numeric sum of the two face up cards with the selected sets of winning numbers (step 34), and the dealer distributing one-half of the pot to each player whose winning numbers include the numeric sum of the face up cards (step 36). If the face up cards are equal to two predetermined key cards (step 30), the dealer and players implement a bonus playing procedure (step 32).

21 Claims, 5 Drawing Sheets

METHOD OF PLAYING A WAGERING GAME

TECHNICAL FIELD

The present invention pertains generally to games and more particularly to wagering games.

BACKGROUND ART

The present invention constitutes a novel wagering game for which no applicable prior art has been identified. However, the game of conventional five card draw poker is employed in one step of the present invention.

DISCLOSURE OF INVENTION

The present invention is directed to a wagering game which is played by a plurality players, and includes a dealer and a deck of playing cards. The players each select a different set of winning numbers. The players may win a hand by either having one of the winning numbers of their set match the numeric sum of two cards that are subsequently turned face up by the dealer, or by winning a bonus playing procedure if the two face up cards are two predetermined key cards.

In accordance with a preferred embodiment of the invention, the players each place wagers which are combined to form a pot, and then each player selects a set of winning numbers from a plurality of sets of winning numbers. The dealer deals two cards face up, compares the face up cards with two predetermined key cards, and if the two face up cards equal the key cards the dealer and the players implement a bonus playing procedure. Otherwise, the dealer computes the numeric sum of the two face up cards and distributes one-half of the pot to each player whose winning number set includes the computed numeric sum.

In accordance with an important aspect of the invention, the wagers of all players equal a predetermined table limit.

In accordance with an important feature of the invention, a plurality of playing positions each having one set of winning numbers are arranged in successive order around a playing table. The players each occupy one of the playing positions.

In accordance with a preferred embodiment of the invention, one or all of the players are afforded the opportunity of selecting a desired playing position other than that which the player is physically occupying.

In accordance with another important feature of the invention, the two predetermined key cards are the jack of spades and the jack of hearts.

In accordance with another important aspect of the invention, the numeric sum is determined by assigning a value of zero to face cards, a value of one to aces, and the face value to all other cards.

In accordance with a preferred embodiment of the invention, the dealer performs a selected series of additional steps prior to dealing the two winner-determining cards face up.

In accordance with another preferred embodiment of the invention, the bonus playing procedure comprises a hand of five card draw poker.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
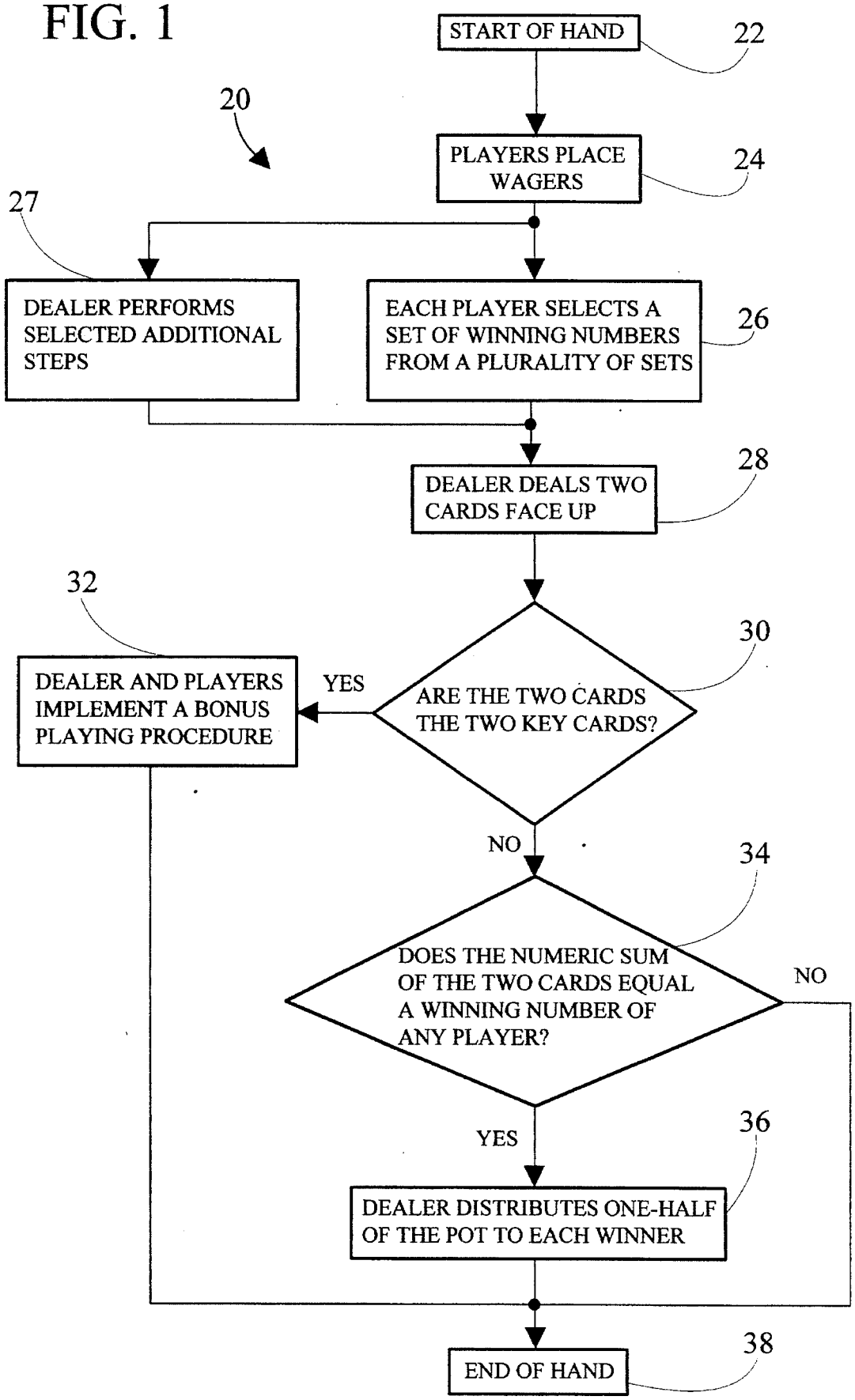
FIG. 1 is a flow diagram illustrating the steps and method of play of a game in accordance with the present invention, generally designated as 20.

Referring initially to FIG. 1, there is depicted a flow diagram illustrating the steps and method of playing a wagering game wherein wagers and a predetermined bonus are apportioned between a plurality of game players in accordance with the present invention, generally designated as 20. The game comprises a plurality of players, a dealers a deck of playing cards, and is especially suited for play at a casino or other gaming establishment. In a preferred embodiment the playing cards are a standard 52 card deck, however other deck configurations such as those having jokers could also be employed with minor playing and rule adjustments. Additionally, one deck may be utilized, or multiple decks may be dealt from a dealing device such as a shoe. A hand begins with start terminator step 22. In step 24 the dealer calls for wagers 100 and the players place their wagers 100 in betting areas directly in front of them on the playing table 102 (refer to FIG.2). The wagers 100 are collected by the dealer and combined to form a pot 104 in the center of table 102. The dealer divides the pot 104 into two halves. In accordance with a preferred embodiment, the wagers of each player are the same amount and equal a predetermined table limit (such as $4, $8, $20, $100, etc.). Another embodiment of wagering step 24 includes an additional step wherein each of the players contributes a predetermined collection amount to the dealer in addition to wager 100. When the present game is played at a casino or other gaming establishments this collection amount constitutes payment for the cost of conducting the game and includes a profit for the casino (house). The amount of the collection is determined by the casino and may be upwardly adjusted to increase their profit margin, or downwardly adjusted to decrease their profit margin and perhaps attract more players.

Figure 2:
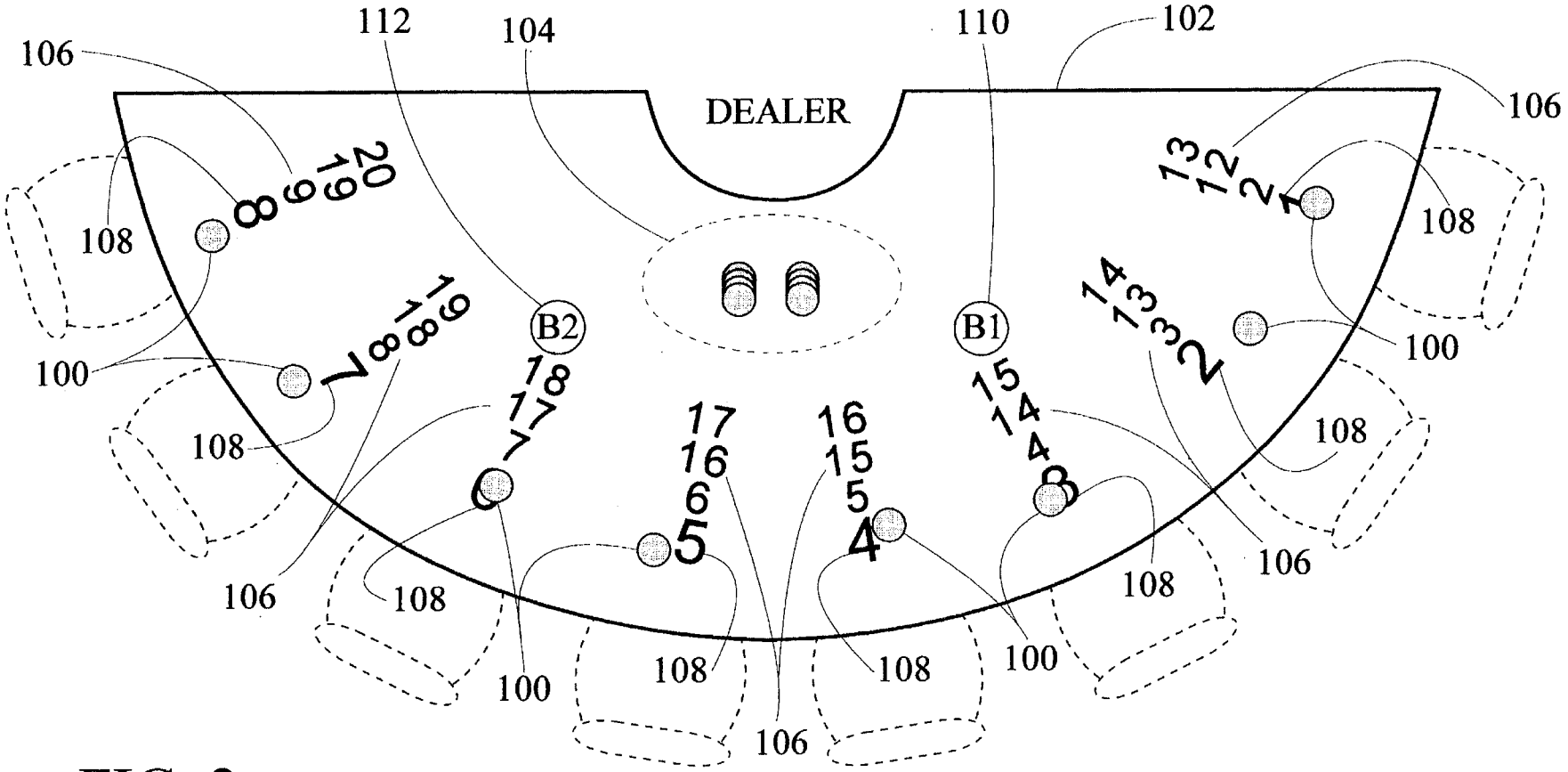
FIG. 2 is a plan view of a first playing table layout.

In step 26 the players each select a set of winning numbers 106 from a plurality of sets of winning numbers 106. Several alternative embodiments of step 26 have been found useful, and are described in the following paragraphs:

In a first playing option, the playing table 102 is partitioned into a plurality of physical playing positions 108 arranged in successive order, each of the playing positions 108 being assigned one set of winning numbers 106 denoted by distributed indicia disposed on playing table 102 for each set of winning numbers 106 (refer to FIG. 2). The players physically occupy a playing position 108 and receive the corresponding set of winning numbers 106 for that playing position 108. Table 1 depicts sets of winning numbers 106 for eight and ten playing positions 108. Playing position 1 has the four winning numbers 1, 2, 12, and 13. The player occupying position 1 will win one-half of the pot 104 if the numeric sum of the two face up cards of step 28 (discussed below) total to any one of these four numbers. For example, a five and a seven, or a four and a nine, or an ace and a face card, etc. (face card=0, ace= 1, others at face value). Playing positions 2 through 8 have similar sets of four winning numbers 106. It is noted that positions 2 through 7 each have all of the numbers in their winning number sets 106 common with another playing position 108. That is, for playing position 2, the numbers 2 and 13 are common with playing position 1, and the numbers 3 and 14 are common with playing position 3. Therefore, when playing positions 2 through 7 win, the pot 104 will always be divided in step 36 (discussed below) with another playing position 108 and no half-pot carryover wager can result. Playing positions 1 and 8 however only share two of the winning numbers in their winning number sets 106 with other playing positions 108, and therefore should playing position 1 win on numeric sums 1 or 12, or should playing position 8 win on numeric sums 9 or 20, there will be a single winner and half of the pot 104 will remain as a carryover wager for the next hand. It is also noted, that for eight playing positions 108, numeric sums

TABLE 1

SETS OF WINNING NUMBERS FOR EIGHT AND TEN PLAYING POSITIONS

| | WINNING NUMBERS | | | |
|---|---|---|---|---|
| FOR EIGHT PLAYING POSITIONS: | | | | |
| PLAYING POSITION 1: | 1, (48) | 2, (54) | 12, (70) | 13 (64) |
| PLAYING POSITION 2: | 2, (54) | 3, (64) | 13, (64) | 14 (54) |
| PLAYING POSITION 3: | 3, (64) | 4, (70) | 14, (54) | 15 (48) |
| PLAYING POSITION 4: | 4, (70) | 5, (80) | 15, (48) | 16 (38) |
| PLAYING POSITION 5: | 5, (80) | 6, (86) | 16, (38) | 17 (32) |
| PLAYING POSITION 6: | 6, (86) | 7, (96) | 17, (32) | 18 (22) |
| PLAYING POSITION 7: | 7, (96) | 8, (102) | 18, (22) | 19 (16) |
| PLAYING POSITION 8: | 8, (102) | 9, (112) | 19, (16) | 20 (6) |
| FOR TEN PLAYING POSITIONS (ADD): | | | | |
| PLAYING POSITION 9: | 9, (112) | 10, (118) | 20 (6) | |
| PLAYING POSITION 10: | 1, (48) | 10, (118) | 12 (70) | |

0, 10, and 11 are not included in the winning numbers sets 106 of any playing position 108, and that therefore if these numeric sums arise the entire pot 104 will be carried over to the next hand. Similarly, for ten playing positions 108, numeric sum 11 is not used. The figures shown in parenthesis below each winning number in Table 1 are the total possible number of two card combinations that will result in that number. For example for playing position 1, there are 48 different two card combinations which will result in a numeric sum of 1 according to the preferred numeric assignment schedule (face card=0, ace= 1, others at face value). It is noted that the total number of possible combinations for each playing position 108 is 236, therefore giving each player an equal probability of winning any given hand. Table 2 shows all possible two card hands, 1326 in total, and shows the derivation of the parenthetical numbers of Table 1. For example, in Table 2 for the number "0" there are six possible Jack-Jack combinations, six possible Queen-Queen combinations, and six possible King-King combinations. Additionally, there are 16 possible Jack-Queen combinations, 16 possible Jack-King combinations, and 16 possible Queen-King combinations. This results in a total of 3×6+(3×16)=66 combinations. A similar analysis applies to the numbers "1" through "20". An analysis of Table 1 reveals that in an eight handed game there will be two winners 62.3% of the time, there will be one winner 17.8% of the time, and there will be no winners (numbers 0, 10, and 11) 19.9% of the time.

In a second playing option, during each hand one player is afforded the opportunity of selecting a desired playing position 108 other than that which the player is physically occupying. A first button (marker) 110 is rotated around the table to successive playing positions 108 to denote which player will receive the selection opportunity for the current hand (refer to FIG. 2). For example, if for the current hand it were playing position

TABLE 2

ALL POSSIBLE TWO CARD HANDS

| NUMERIC VALUE*: | | |
|---|---|---|
| 0 | JJ QQ KK JQ JK QK | 3 × 6 + (3 × 16) = 66 |
| 1 | AJ AQ AK | (3 × 16) = 48 |
| 2 | AA 2J 2Q 2K | 6 + (3 × 16) = 54 |
| 3 | A2 3J 3Q 3K | (4 × 16) = 64 |
| 4 | 22 A3 4J 4Q 4K | 6 + (4 × 16) = 70 |
| 5 | A4 23 5J 5Q 5K | (5 × 16) = 80 |
| 6 | 33 A5 24 6J 6Q 6K | 6 + (5 × 16) = 86 |
| 7 | A6 25 34 7J 7Q 7K | (6 × 16) = 96 |
| 8 | 44 A7 26 35 8J 8Q 8K | 6 + (6 × 16) = 102 |
| 9 | A8 27 36 45 9J 9Q 9K | (7 × 16) = 112 |
| 10 | 55 A9 28 37 46 10J 10Q 10K | 6 + (7 × 16) = 118 |
| 11 | A10 29 38 47 56 | (5 × 16) = 80 |
| 12 | 66 2/10 39 48 57 | 6 + (4 × 16) = 70 |
| 13 | 3/10 49 58 67 | (4 × 16) = 64 |
| 14 | 77 4/10 59 68 | 6 + (3 × 16) = 54 |
| 15 | 5/10 69 78 | (3 × 16) = 48 |
| 16 | 88 6/10 79 | 6 + (2 × 16) = 38 |
| 17 | 7/10 89 | (2 × 16) = 32 |
| 18 | 99 8/10 | 6 + (1 × 16) = 22 |
| 19 | 9/10 | (1 × 16) = 16 |
| 20 | 10/10 | 6 + (0 × 16) = 6 |

*face card = zero, ace = 1, and other cards = face value

3's turn, then player 3 could for example select the winning numbers of playing position 6 and the player at playing position 6 would conversely receive the winning numbers 106 of playing position 3. A second button 112 is used to mark playing position 6 as having been selected by player 3.

In a third playing option, during each hand all of the players are successively afforded the opportunity of selecting a desired playing position 108 other than that which the player is physically occupying. However, once a player has selected a desired playing position 108, a subsequent player cannot select the same playing position 108. In this option a plurality of second buttons 112, marked with the appropriate playing position 108 number, would be required to indicate the various playing position 108 selections of the players.

Figure 3:
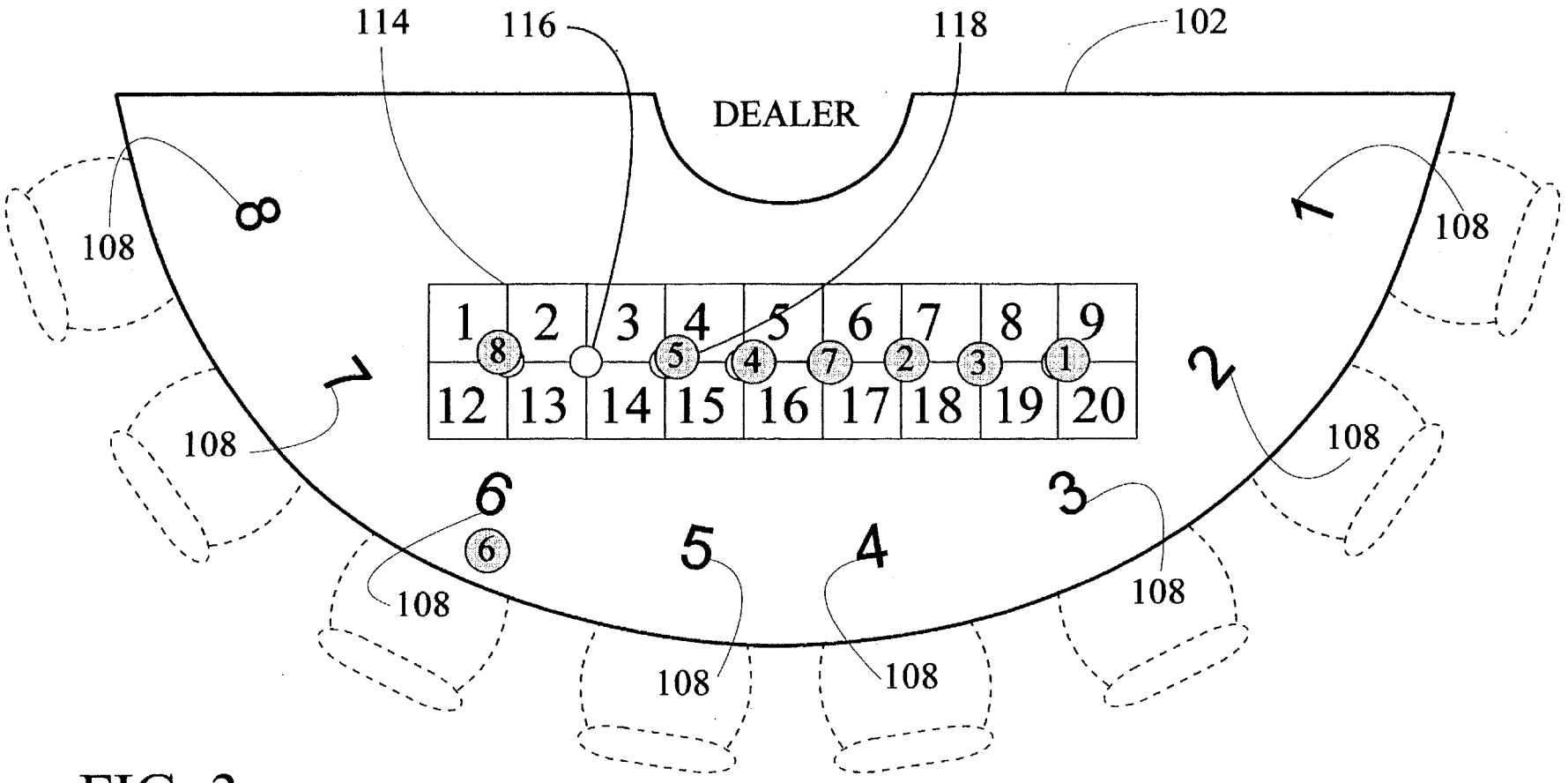
FIG. 3 is a plan view of a second playing table layout.

In a fourth playing option, central indicia 114 containing a plurality of winning number sets is provided (refer to FIG. 3). In a preferred embodiment, central indicia 114 is disposed on playing table 102, and includes one row of winning numbers 1 through 9 positioned adjacent to a second row of winning numbers 12 through 20. Eight circles 116 are placed at the junctions of each four number set, and placement of a playing position numbered button 118 upon the circles 116 constitutes selection of that winning number set. For example, player 5 would select numbers 3, 4, 14, and 15 by placing his/her numbered button 118 at the intersection of those four numbers. All players successively make their selections of winning number sets in rotary order.

Figure 4:
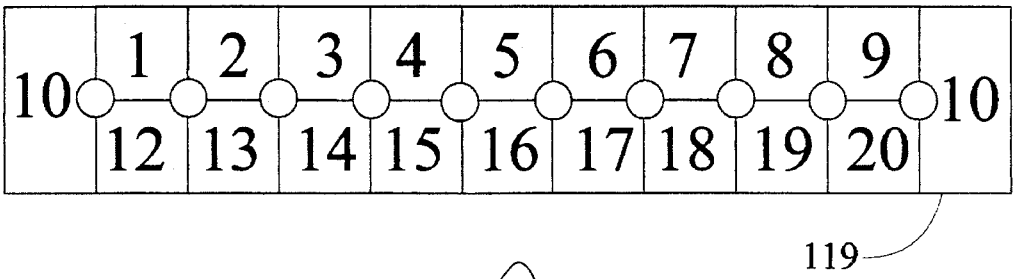
FIG. 4 is a plan view of common indicia for ten playing positions.

FIG. 4 shows ten playing position central indicia 119 wherein the number 10 is added to the ends of the central indicia 114 of FIG. 3. In this embodiment players may also select the winning number combination 10, 1, and 12 as well as the winning number combination 9, 20 and 10.

In any of the four above-cited playing options, it is permissible for one player to occupy as many as two playing positions 108 if all playing positions 108 are not filled by other players. Similarly, if there are two unfilled playing positions 108, then two players could occupy two playing positions 108 each, etc. However in these instances, the player(s) would be required to make two wagers 100. Also, if a vacant playing position 108 is not claimed by another player, then it is customary for the dealer to place a "no bet" button on the unfilled playing position.

Referring again to FIG. 1, in step 28 the dealer uses the playing cards to deal two cards face up. In step 30 the dealer compares the two face up cards with two predetermined key cards. In a preferred embodiment the two predetermined key cards are the one-eyed Jack of Spades and the Jack of Hearts which lend the name of "Bonus Jacks" to the game. It is noted however, that alternatively any two face cards could be selected as the key cards (for example the Queen of Diamonds and the Jack of Clubs). If indeed the two dealt face up cards are the two predetermined key cards then the dealer and the players implement a bonus playing procedure 32 (discussed below). If the two face up cards are not the two key cards, in step 34 the dealer computes a numeric sum of the two face up cards in accordance with a predetermined numeric assignment schedule. In a preferred embodiment the predetermined numeric assignment schedule comprises:

face cards equal zero;

an ace equals one; and, two through ten equal their face value.

Also in step 34, the dealer compares the computed numeric sum with the sets of winning numbers 108 of each playing position 106 (refer to FIG. 2).

In step 36 the dealer distributes one-half of the pot 104 to each player whose set of winning numbers 108 includes the computed numeric sum. Any undistributed portion of the pot 104 constitutes a carryover wager which is retained and combined with the wagers 100 of step 24 of the subsequent hand. An undistributed portion may result from (1) there being only one winner thereby leaving one-half of the pot 104, (2) there being no winners thereby leaving the entire pot 104, or (3) in certain instances where the pot 104 cannot be exactly divided between two winners a residue therefore remaining. In that the carryover wagers consist of contributions made by the present players, it is advisable that a new player not be permitted to enter the game until the entire pot 104 has been distributed and no carryovers remain.

In step 32 the dealer and the players implement a bonus playing procedure. In a preferred embodiment, the bonus playing procedure comprises the players playing a conventional hand of five card draw poker to determine the winner of the pot 104 (refer to FIG. 2) and the predetermined bonus. The dealer deals the poker hand, and distributes the pot 104 and the predetermined bonus to the winning player. If multiple players tie with equal winning poker hands, then the dealer distributes the pot 104 and the predetermined bonus equally between all of the winning players.

Figure 5:
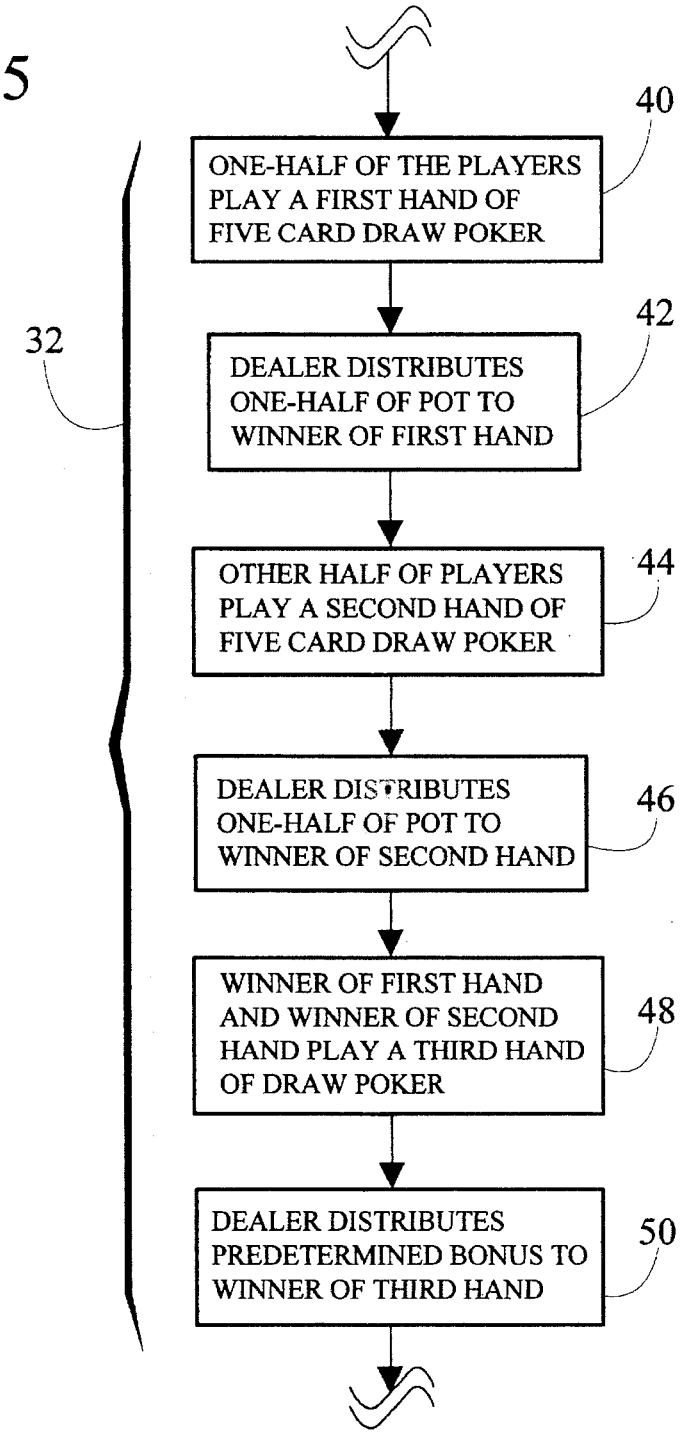
FIG. 5 is a flow diagram of an alternate bonus playing procedure.

Referring to FIG. 5, in another embodiment of the bonus playing procedure, three hands of conventional five card draw poker are dealt to determine the winner of the predetermined bonus amount. First in step 40, one-half of the players, for example those occupying playing positions 1 through 4 (refer to FIG. 2) play a first hand of conventional draw poker and in step 42 the dealer distributes one-half of the pot 104 to the winner of the first hand. Next in step 44, the other half of the players, those occupying playing positions 5 through 8, play a second hand of conventional five card draw poker and in step 46 the dealer distributes the remaining half of the pot to the winner of the second hand. In step 48, the winner of the first hand and the winner of the second hand play a conventional hand of five card draw poker with the dealer in step 50 distributing the predetermined bonus to the winning player of the third hand. When there are an odd number of players, the allocation of the odd player to the first or second hand of draw poker is decided by lot.

Due to the large number of playing positions, it is likely that there will not be sufficient cards to complete the five card draw poker hand. If this occurs the dealer may shuffle and re-deal the discards of previous players. Alternatively, the dealer may employ multiple decks and thereby in most instances avoid occurrences of insufficient cards.

It is noted that while the game of five card draw poker is a preferred embodiment of the present invention, numerous other methods of determining the winner of the pot 104 and predetermined bonus amount are also possible, such as a simple high card cut, five card poker showdown, five card draw loball, etc. The specific method of implementing the bonus playing procedure is determined by the casino, and in some instances would perhaps be influenced by governing state, county or local ordinances.

Figure 6:
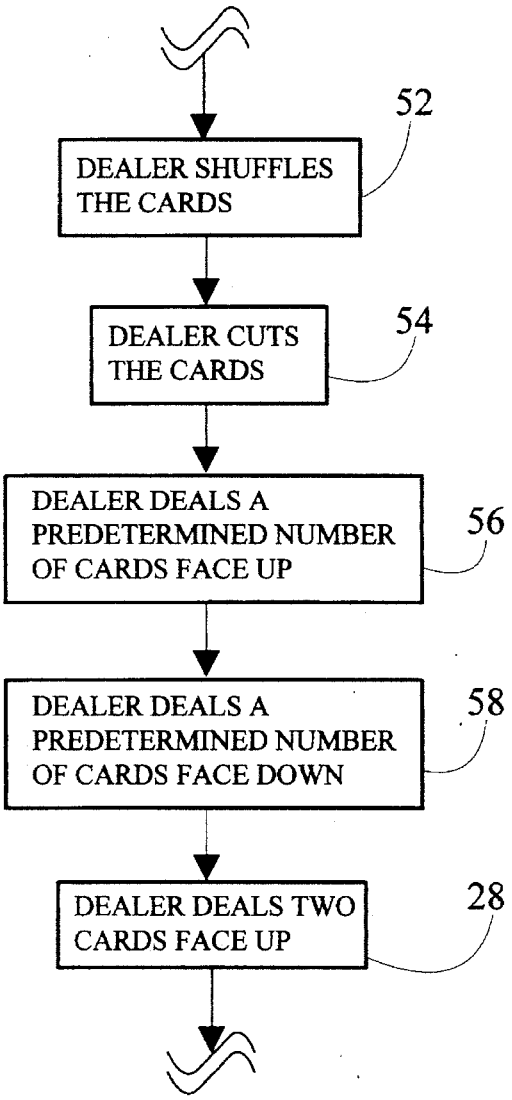
FIG. 6 is a flow diagram illustrating selected additional steps performed by the dealer; and, FIG. 7 is a flow diagram of a preferred embodiment of additional steps.

Referring again to FIG. 1, in step 27 the dealer performs selected additional steps prior to step 28 the dealing of two cards face up. Referring also to FIG. 6, the additional steps included at least one of the following processes:

the dealer shuffling the cards (step 52);

the dealer cutting the cards (step 54);

the dealer dealing a predetermined number of cards face up (step 56); and, the dealer dealing a predetermined number of cards face down (step 58).

Steps 52 thorough 58 can each be performed one or more times and can be performed in any desired order. Additional steps 52 through 58 are designed to enhance player excitement in preparation for step 28 in which the dealer deals the two game determining-cards face up. In a preferred embodiment, the dealing of a predetermined number of cards face up in step 56 is performed prior to the players selecting their sets of winning numbers in step 26. Therefore, the players can observe the occurrence of non-face cards which cannot then be subsequently dealt in step 28. These observed non-face cards may be used by the skilled player during the step 26 selection of a winning set of numbers to improve the player's chance of winning. For example, if three aces were dealt face up during step 56, the probability of the two game-determining cards of step 28 summing to 1 would be reduce substantially.

Figure 7:
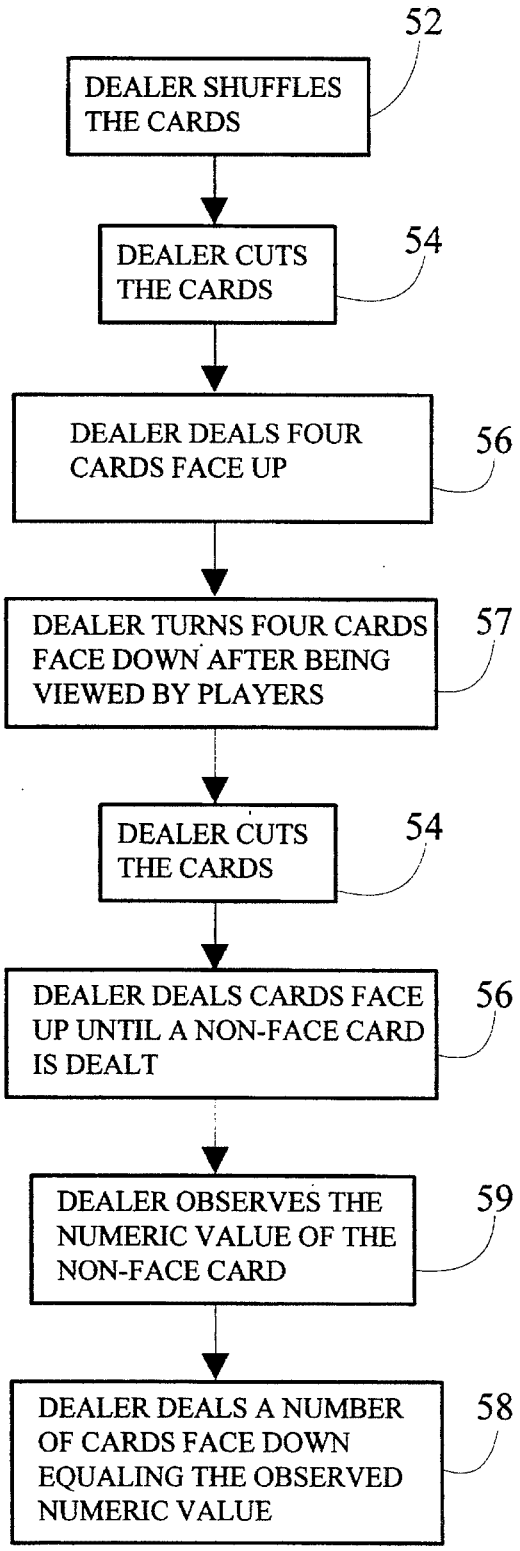

FIG. 7 is a flow diagram of a preferred embodiment of additional steps of FIG. 6 performed by the dealer in step 27 of FIG. 1. In this embodiment the dealer performs the following additional steps:

shuffles the cards (step 52);

cuts the cards (step 54);

deals four cards face up (step 56);

turns the same four cards face down after they have been viewed by the players (step 57);

cuts the cards (step 54);

deals cards face up until a non-face card is dealt (step 56);

observes the numeric value of the face up card (step 59); and, deals a number of cards face down equaling the observed numeric value (step 58).

The numeric value of step 59 comprises and ace equaling one and two through ten equaling their face value.

Again referring to FIG. 1, the game then proceeds to end terminator step 38 and the hand is concluded.

Table 3 depicts four possible game structures for the present invention as they might be employed in a casino environment. It may be readily appreciated that many other similar structures could be envisioned by one skilled in the gaming art. In Table 3, the table limits are $4, $8, $10, $20, and $100, and have predetermined bonus amounts of $500, $1,000, $1,000, $2,500, and $2,500 respectively. The number of Hands per Hour based upon empirical measurements, and the Hourly Cost of Bonus are also shown. The Hourly Cost of Bonus is determined based upon the two key cards occurring once every 1,326 hands. For example, the Hourly Cost of Bonus for the $4 Table Limit is, (500×40)/1326= $15.08 (rounded to $15).

TABLE 3

FIVE POSSIBLE GAME STRUCTURES

| | TABLE LIMIT | | | | |
|---|---|---|---|---|---|
| | $4 | $8 | $10 | $20 | $100 |
| BONUS AMOUNT | $500 | $1,000 | $1,000 | $2,500 | $2,500 |
| HANDS/HOUR | 40 | 45 | 45 | 45 | 45 |
| HOURLY COST/ BONUS | $15 | $34 | $34 | $85 | $85 |

The preferred embodiments of the invention described herein are exemplary and numerous modifications, procedural variations, rearrangements, and adjustments can be readily envisioned to achieve an equivalent result, all of which are intended to be embraced within the scope of the appended claims.

We claim:

1. A method of apportioning wagers and a predetermined bonus between a plurality of game players, comprising the steps of:

providing said plurality of players, a dealer, and a deck of playing cards;

said players each placing a wager, said wagers forming a pot;

said players each selecting a set of winning numbers from a plurality of sets;

said dealer using said playing cards to deal two cards face up;

said dealer comparing said two face up cards with two predetermined key cards, said dealer and said players implementing a bonus playing procedure if said two cards equal said key cards, otherwise said dealer computing a numeric sum of said two cards in accordance with a predetermined numeric assignment schedule and comparing said numeric sum with said set of winning numbers selected by each player; and, said dealer distributing one-half of said pot to each player whose set of winning numbers includes said numeric sum.

2. The method according to claim 1, said wagers equaling a predetermined table limit.

3. The method according to claim 1, wherein said deck is a standard 52 card deck.

4. The method according to claim 1, said step of said players each selecting a set of winning numbers from a plurality of sets further including the steps of:

providing a plurality of playing positions arranged in successive order, said playing positions each having one of said plurality of sets of winning numbers; and, said plurality of players physically occupying said plurality of playing positions.

5. The method according to claim 4, said playing positions and said sets of winning numbers further comprising:

| Playing Position | Sets of Winning Numbers |
|---|---|
| 1 | 1, 2, 12, 13 |
| 2 | 2, 3, 13, 14 |
| 3 | 3, 4, 14, 15 |
| 4 | 4, 5, 15, 16 |
| 5 | 5, 6, 16, 17 |
| 6 | 6, 7, 17, 18 |
| 7 | 7, 8, 18, 19 |
| 8 | 8, 9, 19, 20. |

6. The method according to claim 5, said playing positions and said sets of winning numbers further including:

| Playing Position | Sets of Winning Numbers |
|---|---|
| 9 | 9, 10, 20 |
| 10 | 1, 10, 12. |

7. The method according to claim 4, further including the step of:

one of said players being afforded the opportunity of selecting a desired said playing position other than that which said player is physically occupying.

8. The method according to claim 7, further including the step of:

all of said players successively being afforded the opportunity of selecting a desired said playing position other than that which said players are physically occupying.

9. The method according to claim 4, wherein at least one of said players occupies two of said playing positions.

10. The method according to claim 1, said step of said players each selecting a set of winning numbers from a plurality of sets further including the steps of:

providing indicia containing said plurality of sets of winning numbers; and, said players successively selecting a set of winning numbers from said indicia.

11. The method according to claim 1, wherein said key cards are the jack of spades and the jack of hearts.

12. The method according to claim 1, wherein said predetermined numeric assignment schedule comprises:

face cards equal zero;

an ace equals one; and, two through ten equal their face value.

13. The method according to claim 1, said step of distributing one-half of said pot further including the step of:

retaining any undistributed portion of said pot as a carryover wager for the subsequent hand.

14. The method according to claim 1, further including the step of:

said players contributing a predetermined collection amount to said dealer.

15. The method according to claim 1, prior to said step of said dealer dealing two cards face up, further including performing an additional step comprising at least one of the following processes being performed at least once:

said dealer shuffling said cards;

said dealer cutting said cards;

said dealer dealing a predetermined number of cards face up, and, said dealer dealing a predetermined number of cards face down.

16. The method according to claim 15, wherein said step of dealing a predetermined number of cards face up and face down further includes the steps of:

said dealer dealing cards face up until a non-face card is dealt;

said dealer observing the numeric value of said face up card; and, said dealer dealing a number of cards face down equaling said numeric value.

17. The method according to claim 16, wherein said numeric value comprises:

ace equals one; and, two through ten equal their face value.

18. The method according to claim 1, said bonus playing procedure including the steps of:

said players playing a hand of conventional five card draw poker; and, said dealer distributing said pot and said predetermined bonus to the winning player of said hand of five card draw poker.

19. The method according to claim 18, said step of distributing said pot and a predetermined bonus further including the step of:

distributing said pot and said bonus equally between multiple winning players of said hand of five card draw poker.

20. The method according to claim 1, said bonus playing procedure including the steps of:

said players playing a hand of five card draw lo-ball poker; and, said dealer distributing said pot and said predetermined bonus to the winning player of said hand of five card draw lo-ball poker.

21. The method according to claim 1, said bonus playing procedure including the steps of:

one-half of said players playing a first hand of conventional five card draw poker;

said dealer distributing one-half of said pot to the winner of said first hand;

the other half of said players playing a second hand of conventional five card draw poker;

said dealer distributing the remaining half of said pot to the winner of said second hand;

said winner of said first hand and said winner of said second hand playing a third hand of conventional five card draw poker; and, said dealer distributing said predetermined bonus to the winner of said third hand of conventional five card draw poker.

* * * * *